US008646119B1

(12) United States Patent
Sheridan

(10) Patent No.: US 8,646,119 B1
(45) Date of Patent: Feb. 11, 2014

(54) POOL CHAIR LIFT AND ASSOCIATED METHOD OF USE

(71) Applicant: Steven W. Sheridan, Port St. Joe, FL (US)

(72) Inventor: Steven W. Sheridan, Port St. Joe, FL (US)

( * ) Notice: Subject to any disclaimer, the term of this patent is extended or adjusted under 35 U.S.C. 154(b) by 0 days.

(21) Appl. No.: 13/828,892

(22) Filed: Mar. 14, 2013

Related U.S. Application Data

(60) Provisional application No. 61/769,017, filed on Feb. 25, 2013.

(51) Int. Cl.
*E04H 4/00* (2006.01)
*A47K 3/02* (2006.01)

(52) U.S. Cl.
USPC ..... 4/496; 4/561.1

(58) Field of Classification Search
USPC ..... 4/496, 560.1–563.1
See application file for complete search history.

(56) References Cited

U.S. PATENT DOCUMENTS

| | | | | |
|---|---|---|---|---|
| 4,941,216 | A | 7/1990 | Boublil | |
| 5,790,995 | A | 8/1998 | Caden et al. | |
| 6,003,168 | A * | 12/1999 | Steadman | 4/562.1 |
| 6,289,534 | B1 | 9/2001 | Hakamiun et al. | |
| D507,769 | S | 7/2005 | Terzo | |
| 7,249,386 | B2 | 7/2007 | Terzo | |

OTHER PUBLICATIONS

"2011 American Pool ADA Compliant Lift Pricing", American Pool Enterprises Inc. Family of Companies, 2011, 8 pages.

Website, "Aqua Creek Products 11th Edition Catalog" 2012, ISSUU—Aqua Creek Products 11th Edition Catalog <http://issuu.com/aqua_creek/docs/aqua_creek_products_11th_edition_catalog?e=7061961/1140273>.

Electronics Covers for Pro Pool/Ranger/Patriot, product No. F-045AC, Sep. 20, 2012, Aqua Creek Products website, <http://aquacreekproducts.com/electronics-cover/>.

Electronics Covers for Scout/Revolution/Titan, product No. F-BCC10, Sep. 20, 2012, Aqua Creek Products website, <http://aquacreekproducts.com/electronics-cover/>.

Lift Covers for Pro Pool/Ranger, product No. F-442PPC, Sep. 24, 2012, Aqua Creek Products website, <http://aquacreekproducts.com/cover/>.

Lift Covers for Scout, product No. F-450SC, Sep. 24, 2012, Aqua Creek Products website, <http://aquacreekproducts.com/cover/>.

"Commercial Series Lifts", Global Lift Corp ISO 9001 Certified—Brochure, 2012, 2 pages.

"All Pool Lifts—ADA Compliant Pool Lift Manufacturer—Global Lift Corp", Internet Archive Wayback Machine website, <http://web.archive.org/web/20130219040541/http://www.globalliftcorp.com/pool-lifts/all-pool-lifts/>, 1 page, retrieved on Aug. 22, 2013.

(Continued)

*Primary Examiner* — Tuan N Nguyen
(74) *Attorney, Agent, or Firm* — Thompson Coburn LLP

(57) ABSTRACT

A chair lift apparatus adapted to transport an individual into and out of a water pool, the chair lift apparatus that includes a frame, a chair, a lift arm, having a first end portion and a second end portion, the first end portion of the lift arm is rotatably attached to the frame and the second end portion of the lift arm is operatively attached to the chair, a linkage, and a linear actuator, having a first actuator portion and a second actuator portion located within a frame, the linear actuator is operable to move the linear actuator between a first actuator position and a second actuator position. There is a protective cover to provide protection from environmental damage and the space between the frame and the linear actuator does not constitute a pinch point when the chair is above the edge of the water pool.

32 Claims, 7 Drawing Sheets

(56) References Cited

OTHER PUBLICATIONS

"Harmar—Pool Lifts", Internet Archive Wayback Machine website, <http://web.archive.org/web/20130121133343/http://www.harmar.com/groups/24>, 1 page, retrieved on Aug. 22, 2013.
"ADA Compliant Pool Lift—Interfab Inc.", Internet Archive Wayback Machine website, <http://web.archive.org/web/20121021223255/http://www.interfab.com/i-Lifts/ILift.aspx>, 2 pages, retrieved on Aug. 22, 2013.
"Control Box CBJ1/CBJ2 Product Data Sheet", Linak, Dec. 2012, 4 pages.
"Setting the Bar Higher 2012 Full Line Catalog", S.R. Smith, 15 pages.
"Pool Lift Covers", S.R. Smith, 2012, 1 page.
"MultiLift Pool Lift Brochure", S.R. Smith, 2012, 3 pages.
Website, <http://uspoollifts.com/wp-content/uploads/2013/02/US114Front-300x400.jpg>, retrieved on Aug. 22, 2013, 1 page.

* cited by examiner

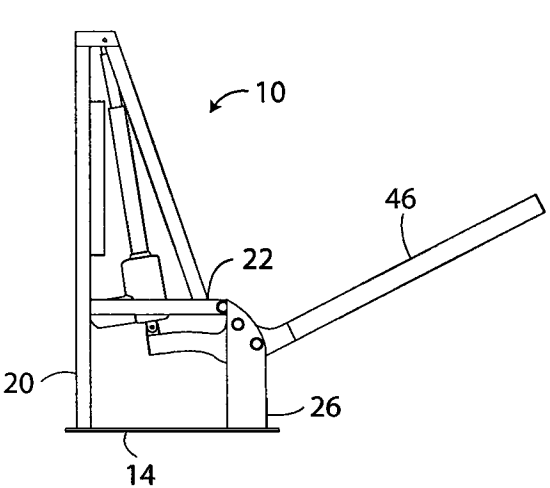
FIG. 12
FIG. 13
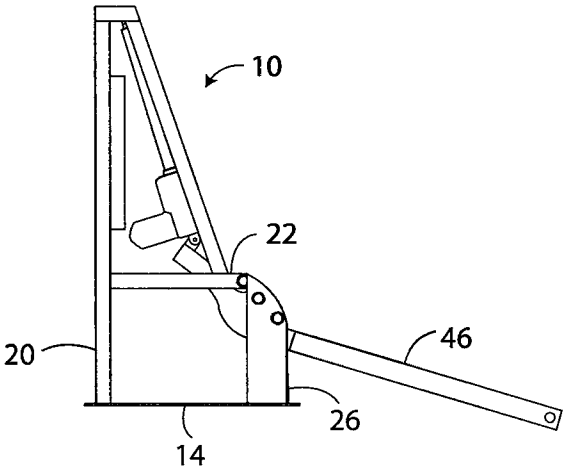
FIG. 14

POOL CHAIR LIFT AND ASSOCIATED METHOD OF USE

CROSS-REFERENCE TO RELATED APPLICATION

This application claims priority of U.S. Provisional Patent Application No. 61/769,017 filed Feb. 25, 2013, which is hereby incorporated herein by reference in its entirety.

BACKGROUND OF THE INVENTION

Electrically powered mechanical swimming pool and spa lifts are available to assist disabled individuals in accessing swimming pools and spas and are commonly referred to as a pool chair lift. This typically includes an electronic drive system, an articulated movement, a base for fixed attachment to the surrounding pool or spa surface, and a seat for the disabled individual.

However, these pool lifts have typically been suitable for use in areas of controlled surrounding such as municipal pools, therapy and elder care facilities that may be indoor, and have staffing provided to readily perform maintenance, set-up and supervision of use. If used outdoors, prior art pool lifts may require removal and placement in protective storage in harsh weather conditions or environments; or special added temporary protection or covering steps that inhibit use of the pool lift. Moreover, these existing pool lifts contain unshielded dangerous mechanical movements that can crush, pinch or otherwise injure a user or bystander.

On Jan. 31, 2013, the United States Justice Department began enforcement of the Americans with Disabilities Act, or "ADA," that mandates, through federal law, that all public pools and spas must eliminate barriers of use of such facilities for those with disabilities. The ADA defines means to eliminate barriers of use of public pools and spas as provision of pool lifts, sloped entry for pools, or both. Pool lifts are required to be installed and ready for use at all times the pool is open. The ADA further sets forth definitions of "public pools" that broadly encompass pools that are not limited to private.

A substantial portion of pools mandated to meet the ADA requirements are not controlled surroundings that have little or no maintenance, set-up staff, or supervision. These pools or spas may be on commercial properties such as hotels, resorts, vacation communities, clubs, condominiums, apartments, community pools, and other locations. Enforcement of the ADA results in new applicable uses unforeseen by prior art device configurations.

Consequently, these existing and known pool lifts are not suitable in non-supervised surroundings and harsh outdoor weather and environmental conditions. Therefore, these pool lifts require either removal or storage; or added physical temporary covering that must be removed before use in outdoors applications that may inhibit use. Moreover, these devices have mechanical movement that renders a fixed protective physical cover for both the electronics and the drive system impractical. Therefore, these known and existing electrically powered mechanical pool lifts present danger in use for operators as well as bystanders.

The present invention is directed to overcoming one or more of the problems set forth above.

SUMMARY OF INVENTION

The present invention is directed to a chair lift to assist disabled individuals in accessing swimming pools and spas that is electrically powered and includes an improved drive system, limiting mechanical movement of electronics, drive actuators and mechanical linkage. The problem of previous lift mechanical movement is solved, providing the ability to use a fixed protective physical covering of the electronic and limited movement drive system. The device meets the need of new pool requirements by being suited for harsh weather and environmental conditions in non-staffed surroundings; as well as provides necessary safety improvement for general public use in such surroundings.

In an aspect of the invention, a chair lift apparatus adapted to transport an individual into and out of a water pool is disclosed. The chair lift apparatus includes a frame, a chair having a seat portion, a lift arm, having a first end portion and a second end portion, the first end portion of the lift arm is rotatably attached to the frame and the second end portion of the lift arm is operatively attached to the chair, a linkage, a linear actuator, having a first actuator portion and a second actuator portion, the linear actuator is operable to move the linear actuator between a first actuator position and a second actuator position, the first and second actuator portions are spaced a first distance when the linear actuator is in the first actuator position, the first and second actuator portions are spaced a second distance when the linear actuator is in the second actuator position, the second distance is different from the first distance, the first actuator portion of the linear actuator is operatively connected to the frame and the second actuator portion of the linear actuator is operatively connected to the lift arm, wherein the linear actuator, the first actuator portion, and the second actuator portion are located internally within the frame, the lift arm and linear actuator being configured and adapted such that movement of the linear actuator between the first actuator position and the second actuator position causes movement of the chair between a first angular position and a second angular position, the first angular position being a position in which the chair is above an edge of the pool, the second angular position being a position in which at least a portion of the chair is submerged in the water of the pool, the chair moving along a curved path as the chair moves between the first angular position and the second angular position, and the linkage being operatively coupled to at least two of the chair, the lift arm, the frame and the linear actuator, the linkage being adapted to maintain the seat portion of the chair generally level as the chair moves between the first angular position and the second angular position.

In yet another aspect of the invention, a chair lift apparatus adapted to transport an individual into and out of a water pool is disclosed. The chair lift apparatus includes a frame, a chair having a seat portion, a lift arm, having a first end portion and a second end portion, the first end portion of the lift arm is rotatably attached to the frame and the second end portion of the lift arm is operatively attached to the chair, a linkage, a linear actuator, having a first actuator portion and a second actuator portion, the linear actuator is operable to move the linear actuator between a first actuator position and a second actuator position, the first and second actuator portions are spaced a first distance when the linear actuator is in the first actuator position, the first and second actuator portions are spaced a second distance when the linear actuator is in the second actuator position, the second distance is different from the first distance, the first actuator portion of the linear actuator is operatively connected to the frame and the second actuator portion of the linear actuator is operatively connected to the lift arm, wherein the linear actuator, the first actuator portion, and the second actuator portion are located internally within the frame, the lift arm and linear actuator being configured and adapted such that movement of the linear actuator between the first actuator position and the second actuator position causes movement of the chair between a first angular position and a second angular position, the first angular position being a position in which the chair is above an edge of the pool, the second angular position being a position in which at least a portion of the chair is submerged in the water of the pool, the chair moving along a curved path as the chair moves between the first angular position and the second angular position, the linkage being operatively coupled to at least two of the chair, the lift arm, the frame and the linear actuator, the linkage being adapted to maintain the seat portion of the chair generally level as the chair moves between the first angular position and the second angular position, an electronic control electrically connected to the rotatable motor, a battery that is electrically connected to the electronic control, and a protective cover enclosing the frame, the linear actuator, the electronic control and the battery for safety and environmental protection, wherein the space between the frame and the linear actuator does not constitute a potential crushing, sheering or pinching area when the chair in the first angular position above an edge of the water pool.

In still another aspect of the invention, a method for utilizing a chair lift apparatus adapted to transport an individual into and out of a water pool is disclosed. The method includes utilizing a linear actuator, having a first actuator portion and a second actuator portion, the linear actuator is operable to move the linear actuator between a first actuator position and a second actuator position, the first and second actuator portions are spaced a first distance when the linear actuator is in the first actuator position, the first and second actuator portions are spaced a second distance when the linear actuator is in the second actuator position, the second distance is different from the first distance, the first actuator portion of the linear actuator is operatively connected to a frame and the second actuator portion of the linear actuator is operatively connected to a lift arm, wherein the linear actuator, the first actuator portion, and the second actuator portion are located internally within the frame, the lift arm and linear actuator being configured and adapted such that movement of the linear actuator between the first actuator position and the second actuator position causes movement of the chair between a first angular position and a second angular position, the first angular position being a position in which the chair is above an edge of the pool, the second angular position being a position in which at least a portion of the chair is submerged in the water of the pool, the chair moving along a curved path as the chair moves between the first angular position and the second angular position, and utilizing a linkage being operatively coupled to at least two of the chair, the lift arm, the frame and the linear actuator, the linkage being adapted to maintain the seat portion of the chair generally level as the chair moves between the first angular position and the second angular position.

Another aspect of the present invention is a protective cover that at least partially extends over the frame and the linear actuator to prevent inadvertent human interaction with the linear actuator during operation and to provide protection from weather and environmental damage.

In yet another aspect of the present invention is to provide a space between the frame and the linear actuator that does not constitute a potential crushing, sheering or pinching area when the chair is in a first angular position above the edge of the water pool.

These are merely some of the innumerable aspects of the present invention and should not be deemed an all-inclusive listing of the innumerable aspects associated with the present invention. These and other aspects will become apparent to those skilled in the art in light of the following disclosure and accompanying drawings.

BRIEF DESCRIPTION OF DRAWINGS

For a better understanding of the present invention, reference may be made to the accompanying drawings in which:

FIG. 11 is an isolated view of a control arm, a lift arm, a linking member and rotatable interconnections in between;

FIG. 12 is a front elevation view of the preferred embodiment of a linear actuator connected to a lift arm in a first angular position above an edge of the water pool in accordance with the invention;

FIG. 13 is a front elevation view of the preferred embodiment of a linear actuator connected to a lift arm in middle angular position between a first angular position above an edge of the water pool and a second angular position located in the water pool in accordance with the invention; and FIG. 14 is a front elevation view of the preferred embodiment of a linear actuator connected to a lift arm in a second angular position located in the water pool in accordance with the invention.

Figure 2:
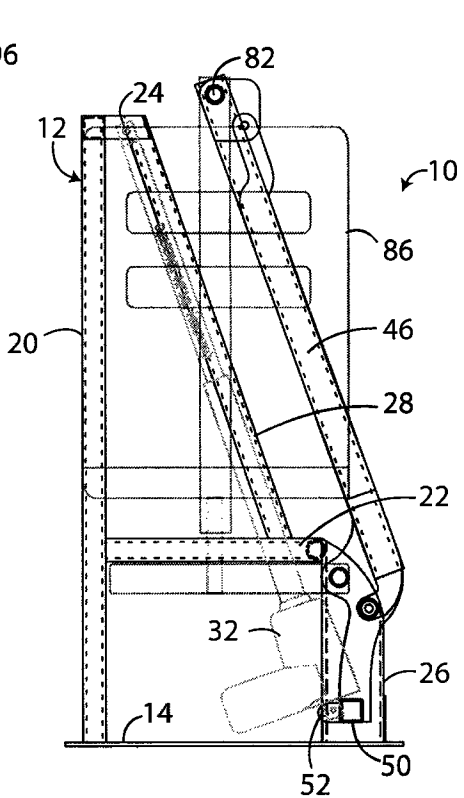
FIG. 2 is a left elevation view of the pool chair lift shown in FIG. 1.

Reference characters in the written specification indicate corresponding items shown throughout the drawing figures.

DETAILED DESCRIPTION OF THE INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

The preferred embodiment of a pool chair lift to assist disabled individuals in accessing swimming pools and spas is shown in FIGS. 1-4 and is generally indicated by numeral 10. A main support structure can include any type of base-type structure. Preferably, but not necessarily, this includes a frame 12. The frame 12 can be any of a wide variety of shapes and sizes. The frame 12 can be manufactured from a wide variety of materials, with the preferred, but nonlimiting, material being stainless steel. A multitude of coatings for the frame 12 may optionally be used. The preferred, but nonlimiting, coating is a multi-step powder coat finish.

The frame 12 includes a bottom member 14 that is attached to a first side member 16, a second side member 18, a back member 20 located away from the pool or spa and a first front member 26 positioned directly in front of the pool or spa. There is an intermediate member 22 that is connected between the back member 20, the first front member 26, the first side member 16, and the second side member 18. There is a second front member 28 that is attached between the intermediate member 22 and the top member 24. Preferably the bottom member 14, top member 24, and intermediate member 22 are substantially horizontal, the first side member 16, the second side member 18, and the first front member 26 are substantially vertical, and the second front member 28 is substantially at an angle. This design of the frame 12 with a triangular top portion and a rectangular bottom portion is merely preferred and any of a wide variety of frame shapes and styles can suffice.

A linear actuator 30 is connected to the top member 24 of the frame 12. A linear actuator can be any of a wide variety of devices that creates motion in a straight line. Illustrative, but nonlimiting examples, may include mechanical, electro-mechanical, linear motor, hydraulic, pneumatic, sleeveless solenoid, screw-type, rod-type, sleeveless, integrated, belt drive, among numerous other types of linear motion devices.

Figures 3, 4:
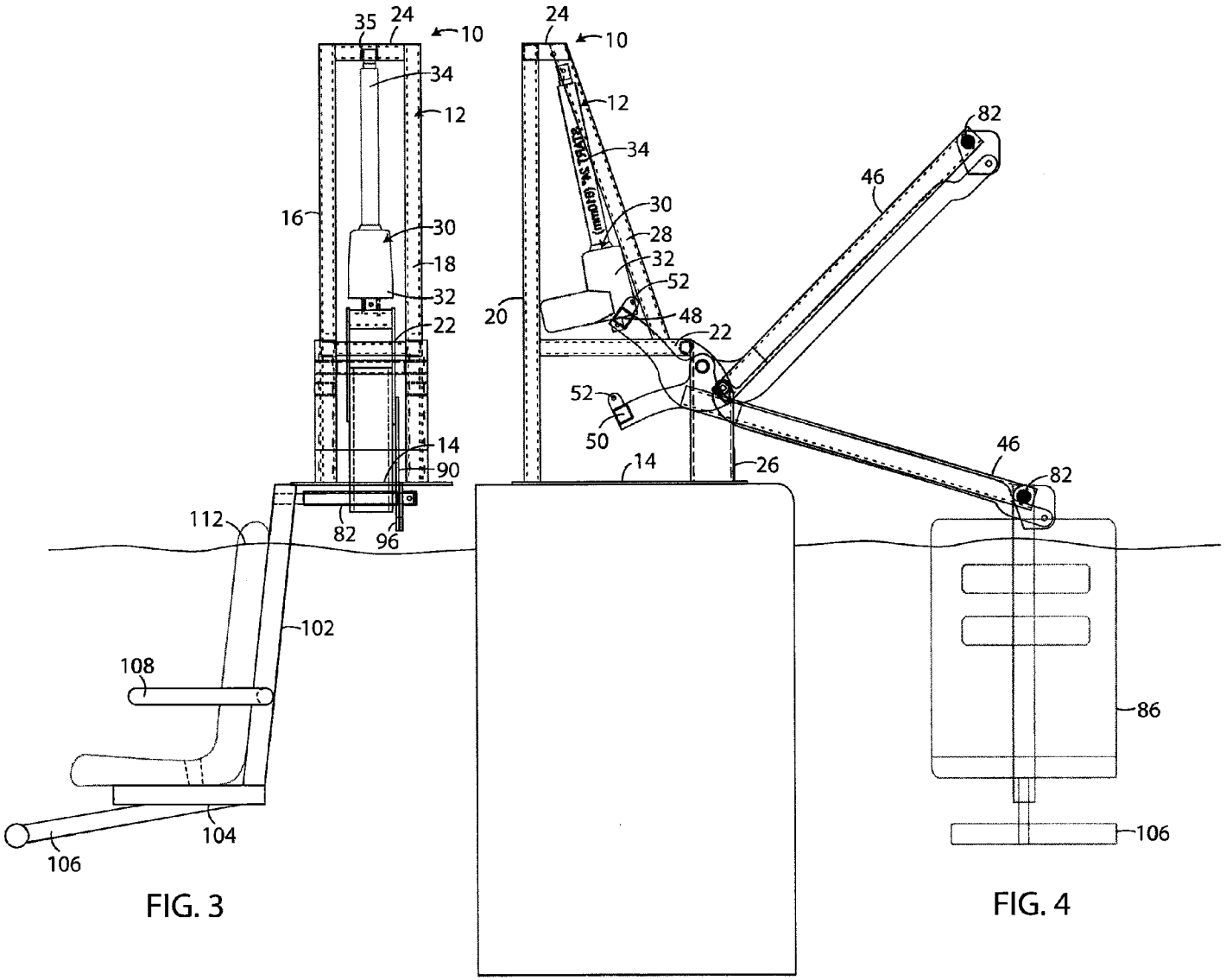
FIG. 3 is a front elevation view of the preferred embodiment of a pool chair lift facing a pool of water in a second angular position located in the water pool in accordance with the invention.
FIG. 4 is a left elevation view of the pool chair lift shown in FIG. 3.
Figure 5:
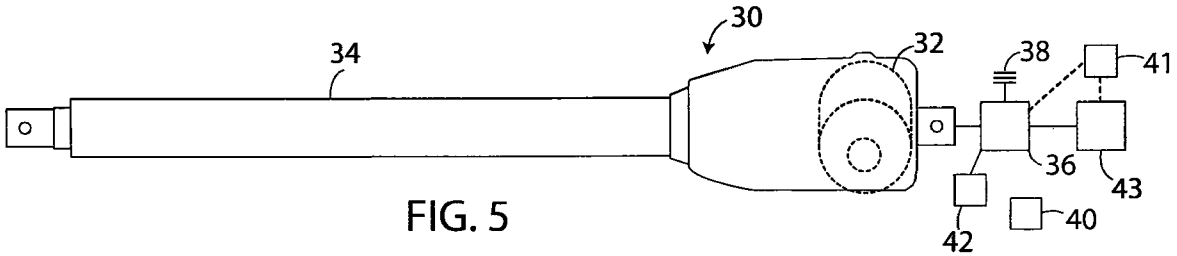
FIG. 5 is a perspective view of a linear actuator utilized in the present invention in a retracted position.
Figure 6:
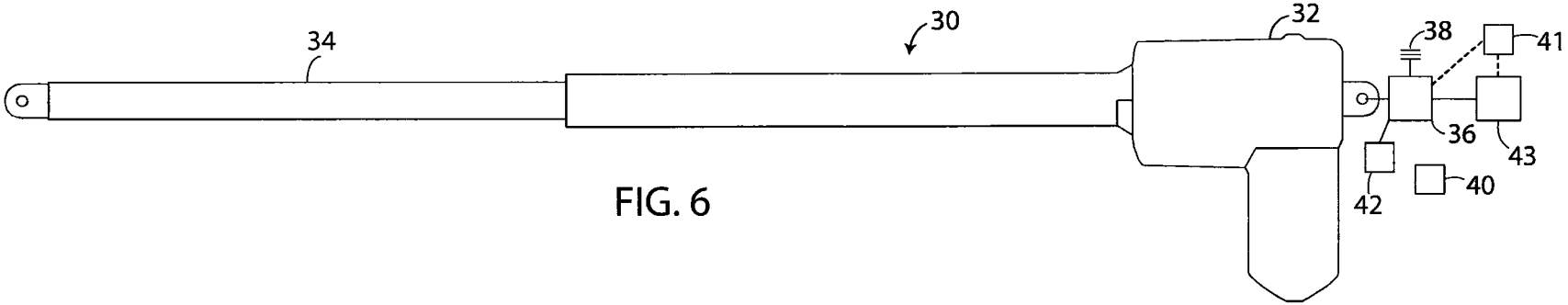
FIG. 6 is a perspective view of a linear actuator shown in FIG. 5 in an extended position.

Referring now to FIGS. 5 and 6, the linear actuator 30, of an illustrative but nonlimiting embodiment, typically includes an electric motor 32 that is mechanically connected to rotate a member, e.g., lead screw, 34. FIG. 5 shows the member, e.g., lead screw, 34 fully retracted in a first actuator position and FIG. 6 shows the member, e.g., lead screw, 34 fully extended in a second actuator position. Although either portion of the linear actuator may be secured to the to the top member 24 of the frame 12, preferably the member, e.g., lead screw, 34 being the first portion is secured to the top member 24 through attachment hardware, e.g., tab, 35 as shown in FIGS. 1-4. A wide variety and types of linear actuators 30 may suffice, with a preferred linear actuator being electric. An illustrative, but nonlimiting, linear actuator 30 may include a LINAK® Model LA34 manufactured by LINAK U.S. Inc., having a place of business at 2200 Stanley Gault Parkway, Louisville Ky. 40223.

Preferably, the linear actuator 30 is connected to an electronic control, e.g., control box, 36. A wide variety of electronic controls, e.g., control box, 36 may suffice. An illustrative, but nonlimiting example includes LINAK® Model CBJ1 or CBJ2 manufactured by LINAK U.S. Inc., having a place of business at 2200 Stanley Gault Parkway, Louisville Ky. 40223.

Optionally, the electronic control, e.g., control box, 36 may include a wireless antenna 38 that can be operated by a remote control 40. An illustrative example of these types of wireless controls can be found at Control All Wireless DLM Inc., having a place of business at 311 2nd Street SW, Buffalo Wright, Minn. 55313.

The electronic control, e.g., control box, 36 can be powered by any of a wide variety of power supplies. The preferred illustrative, but nonlimiting example, includes a battery 43, e.g., twenty-four volt DC, which is contained within the frame 12. An illustrative, but nonlimiting example includes LINAK® Model BAJ1 or BAJ2 manufactured by LINAK U.S. Inc., having a place of business at 2200 Stanley Gault Parkway, Louisville Ky. 40223. However, a receptacle 42 for receiving AC or DC power supply is also an option. A solar panel 41 can be utilized to provide voltage directly to the electronic control, e.g., control box, 36 or to charge the battery 43. There are numerous types of solar panels that can be applied to this application and the choice would depend on the type of linear actuator 30 that is utilized and the power requirements for that particular linear actuator 30.

Figure 7:
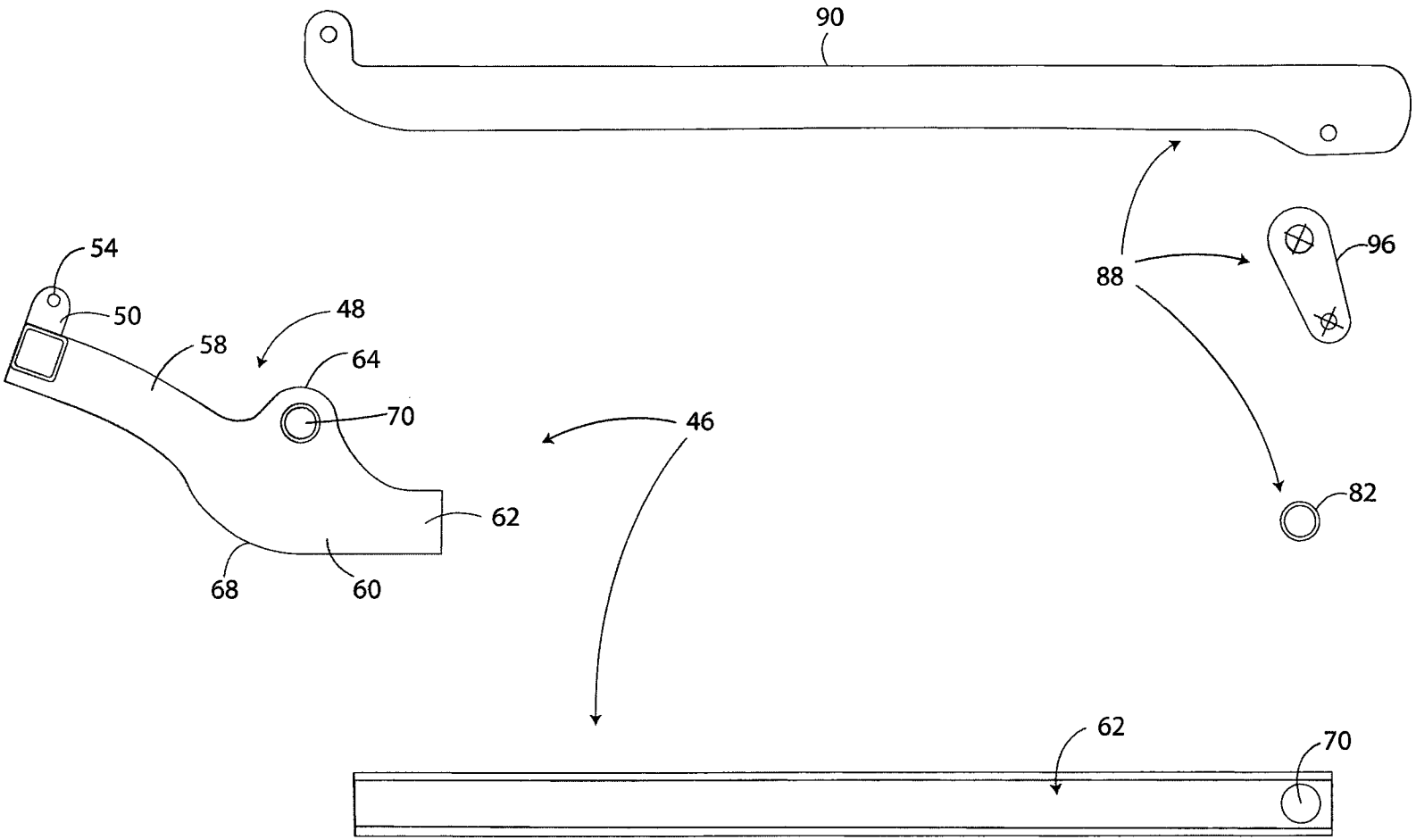
FIG. 7 is an isolated top view of a mount, a lift arm and a control arm.

Referring to FIGS. 2, 4, 7, 10 and 11, the second portion of the linear actuator, e.g., electric motor, 32 is attached to a lift arm 46. As shown in FIG. 7, the first portion 48 of the lift arm 46 is considered both a fork and actuator mount and includes a first end portion of the first portion of a lift arm 58, a middle portion of the first portion of a lift arm 60, and a second end portion of the first portion of a lift arm 62. The second portion of the linear actuator, e.g., electric motor 32 is attached to a first end portion of the first portion of a lift arm 58. A wide variety of attachment mechanisms, e.g., hardware, welding, brazing, adhesives, will suffice for this application. An illustrative, but nonlimiting example includes a mount 50 through hardware, e.g., nut and bolt combination 52, shown in FIGS. 2 and 3, through an aperture 54.

The middle portion of the first end portion 60 of lift arm 46 preferably, but not necessarily, includes a first elliptical portion 64 and second elliptical portion 68, as shown in FIG. 7. There is a circular aperture 70 in the middle portion of the first end portion 60 of a lift arm 46. The second end portion of the first portion of a lift arm 62 preferably, but not necessarily, includes a rectangular portion. A wide variety of shapes can be utilized for the second end portion of the first portion of a lift arm 62.

Figure 11:
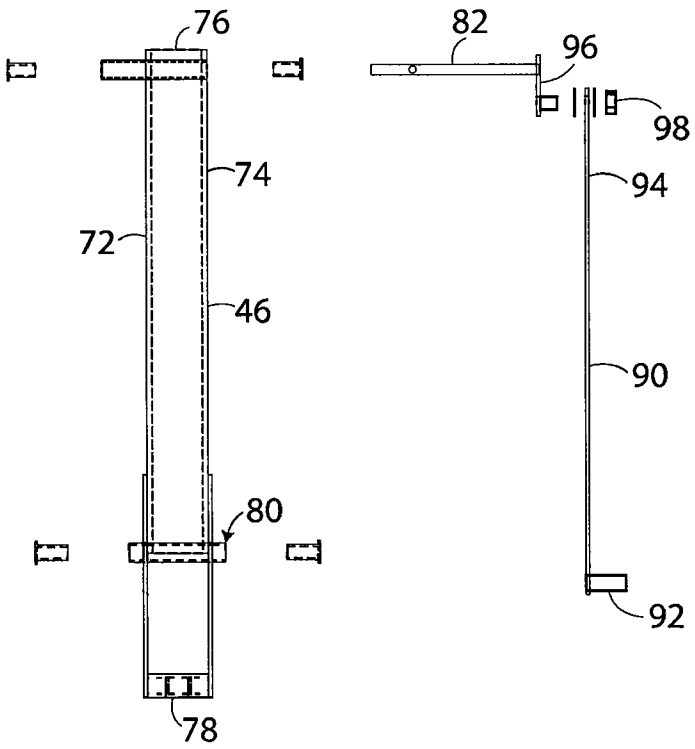
Figure 10:
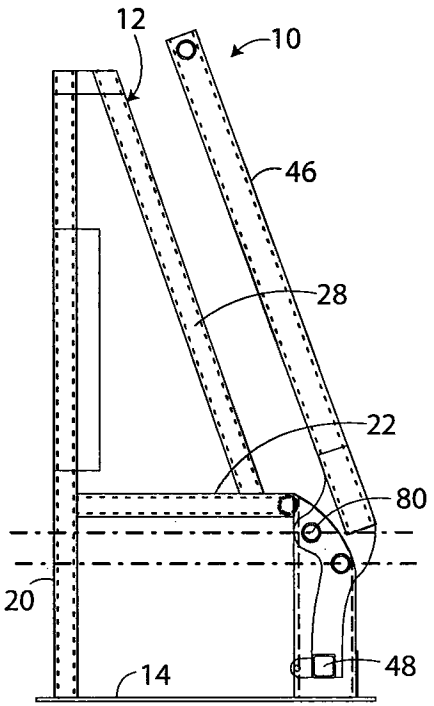
FIG. 10 is side elevation view of the pool chair lift shown in FIG. 1 without a linear actuator and includes an electronic control.

The second end portion 62 of lift arm 46 includes a circular aperture 70. Preferably, the second end portion 62 of lift arm 46 is rectangular but any a wide variety of geometric shapes will suffice. As shown in FIG. 11, the preferred embodiment for the lift arm 46 is a first side member 72, a second side member 74, a first end member 76, and a second end member 78. Preferably, first end portion 48 and the second end portion 62 of the lift arm 46 are an integral structure. However, the first end portion 48 and the second end portion 62 of the lift arm 46 may be manufactured separated and bonded or attached together. There is a rotatable attachment mechanism 80 to attach the lift arm 46 to the frame 12. An illustrative, but nonlimiting, example of a first rotatable attachment mechanism 80 may include a bolt extending through a bushing and secured with a nut, but any of a wide variety of rotatable attachment mechanisms can suffice.

The second end portion 62 of the lift arm 46 is rotatably mounted to a chair 86 for lifting a person into and out of the pool of water. A preferred but nonlimiting example includes a shaft, e.g., circular tube, 82 as shown in FIGS. 7 and 11.

A component to maintain the chair 86 in a substantially vertical position throughout a curve between a first angular position and a second angular position includes linkage 88. There are a wide variety of linkages that may suffice. An illustrative, but nonlimiting example of a linkage 88 includes a control arm 90 that has a first end portion 92 that is connected to the frame 12, as shown in FIG. 11. The second end portion 94 of the control arm 90 is rotatably attached to a link member, e.g., timing link, 96 through hardware 98, e.g., nut and bolt combination with washers.

The shaft, e.g., circular tube, 82 is rotatably attached to a vertical member 100 that is attached to a back portion 102 of the chair 86, as shown in FIGS. 1-4. The back portion 102 of the chair 86 is preferably attached to a seat portion 104 of the chair 86. There is preferably a footrest 106 that can either be fixed or retractable by pivoting or otherwise and is connected to the seat portion 104 of the chair 86. There is also preferably a pair of armrests 108 that are attached at each side of the chair 86 to the back portion 102. The pair of arm rests 108 may also be fixed or retractable by pivoting or otherwise. Seating material 112 is preferably utilized for the comfort of the user and can be utilized on both the seat portion 104 as well as the back portion 102. An illustrative, but nonlimiting material includes polyethylene material to resist environmental degradation.

Figure 9:
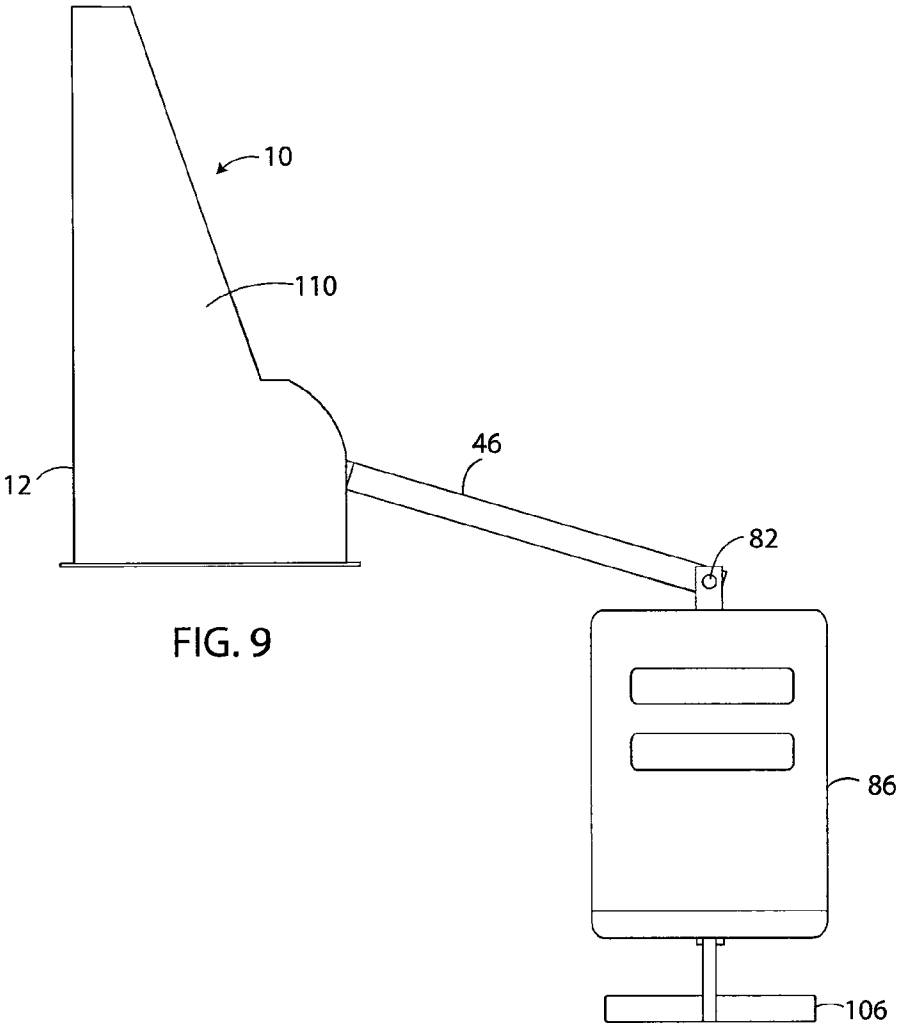
FIG. 9 is left elevation view of the pool chair lift shown in FIG. 4 with a protective enclosure for the pool chair lift of the present invention in a second angular position located in the water pool.
Figure 8:
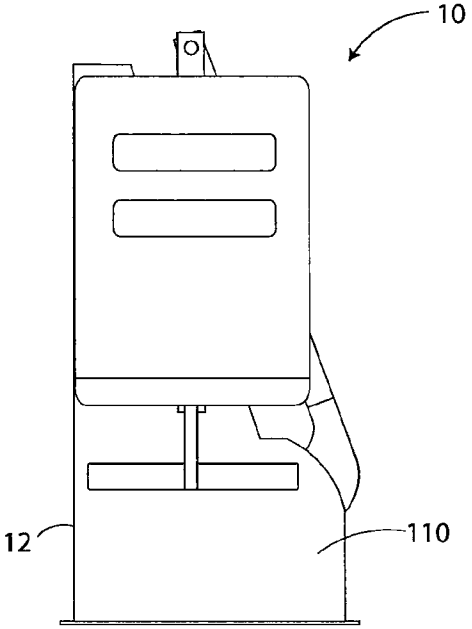
FIG. 8 is left elevation view of the pool chair lift shown in FIG. 2 with a protective enclosure for the pool chair lift of the present invention in a first angular position above an edge of the water pool.

A protective covering 110 is provided to cover both the frame 12, the linear actuator 30 and all associated electronic control, e.g., control box, 36, battery 43, and so forth, and is spatially stationary, as shown in FIGS. 8 and 9. This protective cover 110 prevents inadvertent human interaction with the linear actuator 30 during operation. The protective coating also provides for protection as a safety barrier against unintended entanglement of the user or bystander during use and during mechanical movement. This protective covering 110 substantially protects the electronics and mechanical actions from weather and environmental damage during use and nonuse. Therefore, the invention meets the need for an electrically powered mechanical pool and spa lift that can be installed and ready for use at all times, is suitable to withstand harsh weather and environments without requirement for added maintenance or set-up staffing, or inhibition of use caused by added physical temporary covering that must be removed before use; and provides for safe operation in the new required ADA application of use. Moreover, the reduced movement of the drive system of the invention allows electronic controls and the drive system to be contained within a permanent and fixed protective physical cover. The permanent and fixed protective cover 110 of the invention is constructed to protect the electronics and drive system from harsh weather and environmental use concerns including but not limited to exposure to prolonged UV and infrared load from the sun, precipitation, salt spray, airborne sand or dirt, and chlorine. Chlorides are known to cause corrosion. Pool lift exposure to any or all of the listed conditions can lead to high maintenance cost, and potential failure. This protective cover 110 is constructed to facilitate airflow, preventing chlorides from accumulating, however, continues to inhibit other weather and environmental concerns from entering the frame 12 with the electronics and drive system.

The protective cover 110 can be made of a wide variety of materials and preferably includes chemically treated fabric to provide protection from weather and environmental damage. An example would include canvas-type awning material that releases moisture but still provides protection.

Figure 1:
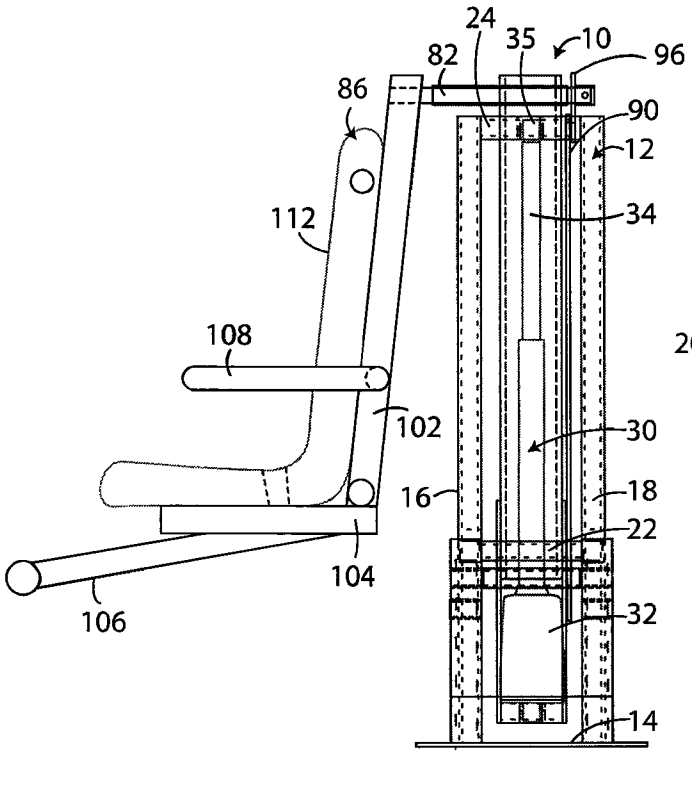
FIG. 1 is a front elevation view of the preferred embodiment of a pool chair lift facing a pool of water in a first angular position above an edge of the water pool in accordance with the invention.

In operation, the lift arm 46 and linear actuator 30 being configured and adapted such that movement of the linear actuator 30 between a first actuator position and a second actuator position that causes movement of the chair 86 between a first angular position and a second angular position, where the first angular position being a position in which the chair is above an edge of the pool as shown in FIGS. 1, 2, and 12. There is a second angular position being a position in which at least a portion of the chair 86 is submerged in the water of the pool as shown in FIGS. 3, 4 and 14. The chair 86 is moving along a curved path as the chair 86 moves between the first angular position and the second angular position through a middle position shown in FIG. 13. Preferably, this rotational movement is through a single plane.

Furthermore, it should be understood that when introducing elements of the present invention in the claims or in the above description of the preferred embodiment of the invention, the terms "have," "having," "includes" and "including" and similar terms as used in the foregoing specification are used in the sense of "optional" or "may include" and not as "required." Similarly, the term "portion" should be construed as meaning some or all of the item or element that it qualifies.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims that follow.

The invention claimed is:

1. A chair lift apparatus adapted to transport an individual into and out of a water pool, the chair lift apparatus comprising:

a frame;

a chair having a seat portion;

a lift arm, having a first end portion and a second end portion, the first end portion of the lift arm is rotatably attached to the frame and the second end portion of the lift arm is operatively attached to the chair;

a linkage;

a linear actuator, having a first actuator portion and a second actuator portion, the linear actuator is operable to move the linear actuator between a first actuator position and a second actuator position, the first and second actuator portions are spaced a first distance when the linear actuator is in the first actuator position, the first and second actuator portions are spaced a second distance when the linear actuator is in the second actuator position, the second distance is different from the first distance, the first actuator portion of the linear actuator is operatively connected to the frame and the second actuator portion of the linear actuator is operatively connected to the lift arm, wherein the linear actuator, the first actuator portion, and the second actuator portion are located internally within the frame;

the lift arm and linear actuator being configured and adapted such that movement of the linear actuator between the first actuator position and the second actuator position causes movement of the chair between a first angular position and a second angular position, the first angular position being a position in which the chair is above an edge of the pool, the second angular position being a position in which at least a portion of the chair is submerged in the water of the pool, the chair moving along a curved path as the chair moves between the first angular position and the second angular position; and the linkage being operatively coupled to at least two of the chair, the lift arm, the frame and the linear actuator, the linkage being adapted to maintain the seat portion of the chair generally level as the chair moves between the first angular position and the second angular position.

2. A chair lift apparatus according to claim 1, wherein the chair moves between the first angular position and the second angular position to transport the individual into and out of a water pool with a rotational movement through a single plane.

3. A chair lift apparatus according to claim 1, further comprising a protective cover that at least partially extends over the frame to prevent human interaction with the linear actuator, the first actuator portion, and the second actuator portion to prevent inadvertent human interaction during operation.

4. A chair lift apparatus according to claim 3, wherein the protective cover comprises chemically treated fabric to provide protection from weather and environmental damage.

5. A chair lift apparatus according to claim 4, wherein the chemically treated fabric includes canvas.

6. A chair lift apparatus according to claim 1, wherein the space between the frame and the lift arm does not constitute a potential crushing, sheering or pinching area for human extremities when the chair is any position.

7. A chair lift apparatus according to claim 1, wherein the space between the frame and the chair does not constitute a potential crushing, sheering or pinching area for human extremities when the chair is any position.

8. A chair lift apparatus according to claim 6, wherein the space between the frame and the lift arm is at least four inches when the chair is in the first angular position above the edge of the water pool.

9. A chair lift apparatus according to claim 1, wherein the linkage includes a control arm, having a first end portion and a second end portion, the first end portion of the control arm is rotatably attached to the frame, a linking member that is rotatably connected to the second end portion of the control arm and a shaft attached to the chair, wherein the shaft is rotatably connected to the second end portion of the lift arm and the shaft is rotatably connected to the linking member to maintain the chair in a substantially vertical position throughout the curve between the first angular position and the second angular position.

10. A chair lift apparatus according to claim 1, wherein the linear actuator is operable to move the linear actuator between a first actuator position and a second actuator position with electrical power.

11. A chair lift apparatus according to claim 10, further comprising an electronic control that is electrically connected to the linear actuator.

12. A chair lift apparatus according to claim 11, further comprising a mechanism that is capable of receiving electrical power from at least one of a direct current power supply, an alternating current power supply and a battery, which is electrically connected to the electronic control.

13. A chair lift apparatus according to claim 12, wherein the battery that is electrically connected to the electronic control and mounted to the frame.

14. A chair lift apparatus according to claim 13, further comprising a protective cover that at least partially extends over the frame, the linear actuator, the electronic control, and the battery.

15. A chair lift apparatus according to claim 11, further comprising a wireless controller that is electrically connected to the electronic control.

16. A chair lift apparatus according to claim 11, further comprising a solar panel that is electrically connected to the electronic control.

17. A chair lift apparatus according to claim 13, further comprising a battery charger that is electrically connected to the battery.

18. A chair lift apparatus according to claim 13, further comprising a solar panel that is electrically connected to the battery.

19. A chair lift apparatus according to claim 1, wherein the chair includes a back portion.

20. A chair lift apparatus according to claim 1, further comprising a footrest that is attached to the seat portion of the chair.

21. A chair lift apparatus according to claim 20, wherein the footrest is retractable.

22. A chair lift apparatus according to claim 19, further comprising a pair of armrests attached on each side of the chair between the back portion and the seat portion.

23. A chair lift apparatus according to claim 22, wherein the pair of armrests is retractable.

24. A chair lift apparatus adapted to transport an individual into and out of a water pool, the chair lift apparatus comprising:

a frame;

a chair having a seat portion;

a lift arm, having a first end portion and a second end portion, the first end portion of the lift arm is rotatably attached to the frame and the second end portion of the lift arm is operatively attached to the chair;

a linkage;

a linear actuator, having a first actuator portion and a second actuator portion, the linear actuator is operable to move the linear actuator between a first actuator position and a second actuator position, the first and second actuator portions are spaced a first distance when the linear actuator is in the first actuator position, the first and second actuator portions are spaced a second distance when the linear actuator is in the second actuator position, the second distance is different from the first distance, the first actuator portion of the linear actuator is operatively connected to the frame and the second actuator portion of the linear actuator is operatively connected to the lift arm, wherein the linear actuator, the first actuator portion, and the second actuator portion are located internally within the frame;

the lift arm and linear actuator being configured and adapted such that movement of the linear actuator between the first actuator position and the second actuator position causes movement of the chair between a first angular position and a second angular position, the first angular position being a position in which the chair is above an edge of the pool, the second angular position being a position in which at least a portion of the chair is submerged in the water of the pool, the chair moving along a curved path as the chair moves between the first angular position and the second angular position;

the linkage being operatively coupled to at least two of the chair, the lift arm, the frame and the linear actuator, the linkage being adapted to maintain the seat portion of the chair generally level as the chair moves between the first angular position and the second angular position;

an electronic control electrically connected to the rotatable motor;

a low voltage power supply that is electrically connected to the electronic control; and a protective cover enclosing the frame, the linear actuator including the first actuator portion and the second actuator portion, the electronic control and the battery for safety and environmental protection, wherein the space between the frame and the linear actuator does not constitute a potential crushing, sheering or pinching area for human extremities when the chair in the first angular position above an edge of the water pool.

25. A chair lift apparatus according to claim 24, wherein the space between the frame and the lift arm is at least four inches when the chair is in any position.

26. A chair lift apparatus according to claim 24, wherein the linkage includes a control arm, having a first end portion and a second end portion, the first end portion of the control arm is rotatably attached to the frame, a linking member that is rotatably connected to the second end portion of the control arm and a shaft attached to the chair, wherein the shaft is rotatably connected to the second end portion of the lift arm and the shaft is rotatably connected to the linking member to maintain the chair in a substantially vertical position throughout the curve between the first angular position and the second angular position.

27. A chair lift apparatus according to claim 24, wherein the protective cover includes chemically treated fabric to provide protection for human safety and from weather and environmental damage.

28. A method for utilizing a chair lift apparatus adapted to transport an individual into and out of a water pool, the method comprising:

utilizing a linear actuator, having a first actuator portion and a second actuator portion, the linear actuator is operable to move the linear actuator between a first actuator position and a second actuator position, the first and second actuator portions are spaced a first distance when the linear actuator is in the first actuator position, the first and second actuator portions are spaced a second distance when the linear actuator is in the second actuator position, the second distance is different from the first distance, the first actuator portion of the linear actuator is operatively connected to a frame and the second actuator portion of the linear actuator is operatively connected to a lift arm, wherein the linear actuator, the first actuator portion, and the second actuator portion are located internally within the frame, the lift arm and linear actuator being configured and adapted such that movement of the linear actuator between the first actuator position and the second actuator position causes movement of the chair between a first angular position and a second angular position, the first angular position being a position in which the chair is above an edge of the pool, the second angular position being a position in which at least a portion of the chair is submerged in the water of the pool, the chair moving along a curved path as the chair moves between the first angular position and the second angular position; and utilizing a linkage being operatively coupled to at least two of the chair, the lift arm, the frame, and the linear actuator, the linkage being adapted to maintain the seat portion of the chair generally level as the chair moves between the first angular position and the second angular position.

29. A method for utilizing a chair lift apparatus adapted to transport an individual into and out of a water pool according to claim 28, wherein a space between the frame and the lift arm does not constitute a potential crushing, sheering or pinching area for human extremities when the chair is any position.

30. A method for utilizing a chair lift apparatus adapted to transport an individual into and out of a water pool according to claim 29, wherein the space between the frame and the lift arm is at least four inches when the chair is in any position.

31. A method for utilizing a chair lift apparatus adapted to transport an individual into and out of a water pool according to claim 28, further comprising a protective cover enclosing the frame, the linear actuator including the first actuator portion and the second actuator portion.

32. A method for utilizing a chair lift apparatus adapted to transport an individual into and out of a water pool according to claim 31, wherein the protective cover includes chemically treated fabric to provide protection for human safety and from weather and environmental damage.

* * * * *